US006022301A

United States Patent [19]

Fahlman

[11] Patent Number: 6,022,301

[45] Date of Patent: Feb. 8, 2000

[54] WATER EXERCISE DEVICE

[76] Inventor: Gosta Fahlman, P.O. Box. 1534, Cottonwood, Ariz. 86326

[21] Appl. No.: 08/728,994

[22] Filed: Nov. 12, 1996

[51] Int. Cl.[7] ..... A63B 21/008

[52] U.S. Cl. ..... 482/111; 482/112

[58] Field of Search ..... 482/111, 112, 482/124, 125, 126, 129, 128

[56] References Cited

U.S. PATENT DOCUMENTS

| | | | |
|---|---|---|---|
| 4,591,150 | 5/1986 | Mosher | 482/125 |
| 4,884,800 | 12/1989 | Duke . | |
| 5,186,700 | 2/1993 | Wang . | |
| 5,336,142 | 8/1994 | Dalebout et al. . | |
| 5,337,737 | 8/1994 | Rubin et al. . | |
| 5,354,253 | 10/1994 | Awbrey et al. . | |
| 5,529,559 | 6/1996 | Punzalan | 482/112 |

*Primary Examiner*—Richard J. Apley
*Assistant Examiner*—Lori L. Baker-Smith
*Attorney, Agent, or Firm*—Pitts & Brittian, P.C.

[57] ABSTRACT

A water exercise device for exercising in a pool or body of water of the like. The water exercise device includes a cylinder, a rod and piston assembly, a foot rest assembly secured to the second end of the cylinder and a handle secured to the first end of the rod and piston assembly. The cylinder includes a water control valve proximate the first and second ends of the cylinder and permits the flow of water in and out of the cylinder when the piston moved between the first and second ends of the cylinder. The water exercise device also includes a means for supporting the foot rest assembly and includes an attachment assembly and a flotation device. The attachment assembly is for mounting to a structure such as the wall of a pool or a ladder and is configured to securely hold the foot rest assembly. The flotation device is secured to the foot rest assembly to float on the surface of the water and maintains the water exercise device below the water.

6 Claims, 4 Drawing Sheets

WATER EXERCISE DEVICE

TECHNICAL FIELD

This invention relates to the field of exercises devices and specifically an exercise device to be used in water.

BACKGROUND ART

The encouragement for individuals of all ages to exercise has become more emphasized in recent years, as studies have proven the beneficial results of exercise. A few concerns when exercising are overheating and excessive pounding on joints. Exercising in a pool has become popular because the risk of overheating is greatly reduced and the resistance of water helps reduce the stress to the joints. Swimming and water aerobics are the most popular activities done in a pool. More recently, devices have been developed which can be used in a pool or use the resistance of water. Typical of the art are those devices disclosed in the following U.S. Patents:

| U.S. Pat. No. | Inventor(s) | Issue Date |
|---|---|---|
| 4,884,800 | J. H. Dike | December 5, 1989 |
| 5,186,700 | J. Wang | February 16, 1993 |
| 5,336,142 | Dalebout et al. | August 9, 1994 |
| 5,337,737 | Rubin et al. | August 16, 1994 |
| 5,354,253 | Awbrey et al. | October 11, 1994 |

U.S. Patents '800, '700, '142, and '737 utilize water or some other fluid contained in a container to provide resistance for exercise. U.S. Pat. '253 is a device which is mountable to a ladder or the side of an inground pool and provides a variety of attachments which may be adjustably mounted to the device. The device is permanently secured to the ladder or the side of the pool. Moreover, the therapy device is complex in design.

Therefore, it is an object of the present invention to provide a water exercise device which is utilized in a body of water such as a pool.

It is another object of the present invention to provide a water exercise device which is removably mountable to a pool or the like.

Further, it is an object of the present invention to provide a water exercise device which is simple in construction.

SUMMARY

Other objects and advantages will be accomplished by the present invention which provides a water exercise device for use in a pool or the like. The water exercise device of the present invention includes a cylinder, a piston and rod assembly, a handle and foot rest assembly. The cylinder defines a first end, a second end and at least one water control valve mounted proximate the second end. The water control valve permits flow of water in and out of the cylinder. The foot rest assembly is secured to the second end of the cylinder. The piston and rod assembly includes a piston and a rod. The piston is slidable in a sealed manner between the first end and the second end of the cylinder. The rod defines a first end and a second end. The second end is secured to the piston and the handle is secured to the first end.

BRIEF DESCRIPTION OF THE DRAWINGS

The above mentioned features of the invention will become more clearly understood from the following detailed description of the invention read together with the drawings in which.

DESCRIPTION OF PREFERRED EMBODIMENTS

A water exercise device incorporating various features of the present invention is illustrated generally at 10 in the figures. The water exercise device 10 is designed for use in water, most preferably a pool. Moreover, in the preferred embodiment, the water exercise device 10 utilizes water to provide resistance.

Figure 1:
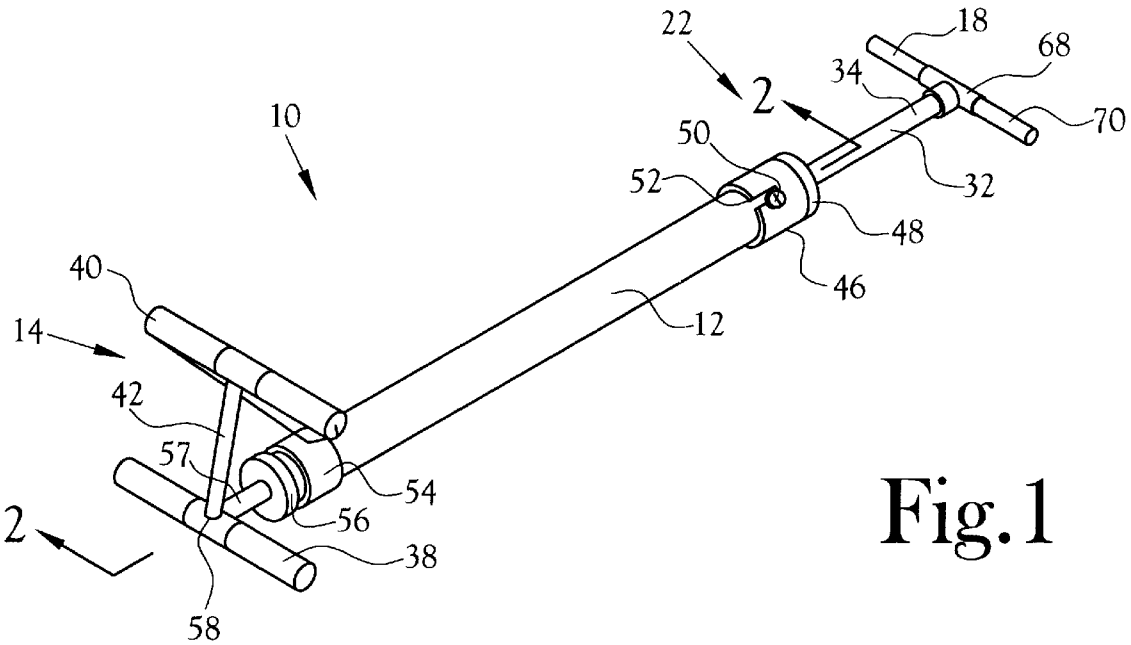
FIG. 1 is a perspective view of the water exercise device of the present invention.

The water exercise device is shown in FIG. 1 and is generally comprised of a cylinder 12, a foot rest assembly 14 and a piston and rod assembly 16 including a handle 18. In the preferred embodiment, the water exercise device 10 also includes a means for supporting the water exercise device 10 at a selected level in the water. This means for support includes an attachment assembly 20 for mounting in a pool or similar body of water and configured to receive the foot rest assembly 14. Further, the means for support includes a flotation device 80 secured to either side of the foot rest assembly 14.

The cylinder 12 defines a first end 22, a second end 24 and an inner cylinder wall 26. Further, the cylinder 12 includes at least one water flow valve 28 mounted through the cylinder proximate the second end 24 thereof. In the preferred embodiment, the cylinder 12 includes an additional water flow valve 28 mounted through the cylinder 12 proximate the first end 22 thereof.

The piston and rod assembly 16, which includes a piston secured to a rod, is removably mounted to the first end 22 of the cylinder 12. The piston 30 is configured to slide in a sealed manner against the inner wall 26 of the cylinder 12 between the first 22 and second ends 24 thereof. The rod 32 defines a first end 34 and a second end 36. The second end 36 of the rod 32 is mounted to the piston 30. The handle 18 is mounted to the first end 34 of the rod 32.

The foot rest assembly 14 is mounted to the second end 24 of the cylinder 12. In the preferred embodiment, the foot rest assembly 14 includes a lower foot bar 38, an upper foot bar 40 and a support shaft 42 extending therebetween. In the preferred embodiment, the support shaft 42 extends 15° from vertical. Moreover, in the preferred embodiment, the position of the upper foot bar 40 is adjustable with respect to the lower foot bar 38. Preferably, the support shaft is a 5×⅜ inch bolt. The lower foot bar 38 is supported by the head of the bolt and held in position with a nut. The upper foot bar 40 is held in position via a wing nut and a wire 41 which is fed through the upper foot bar and secured to the second end of the cylinder 12. It will be noted that any means for supporting the lower and upper foot bar is acceptable.

Although a preferred embodiment of the foot rest assembly 14 is depicted, an alternate embodiment (not shown) includes a foot platform and hook-and-loop fasteners to securely hold the user's feet to the respective foot platform. Further, in an alternate embodiment (not shown), the foot rest assembly consists of rubber straps attached to the T-shaped lower section of the cylinder via aluminum reinforcements. The rubber straps are adjustable in length by hook-and-loop closures.

In the preferred embodiment, the cylinder is fabricated from 2 inch, sch 40 PVC pipe 44 and fittings. Further, in the preferred embodiment, the first end of the cylinder is fitted with a 2 inch coupling 46 with a 2×½ inch bushing 48 glued to the available end of the coupling 46. The bushing 48 is modified to let the rod 32 pass through it in a sealed manner. A screw 50 is mounted on the cylinder 12 proximate its first end 22 and an L-shaped slot 52 is cut into the coupling 46 such that the coupling 46 is removably securable to the cylinder 12.

Further, in the preferred embodiment, the second end 24 of the cylinder 12 is constructed in the following manner. A 2 inch coupling 54 is secured to the cylinder pipe 44 and a 2×¾ inch bushing 56 is secured to the available end of the coupling 54. A ¾ inch pipe 57 is mounted in the bushing 56 and a 1×1×¾ inch tee 58 is mounted to the pipe 57. In the preferred embodiment, the water flow valve 28 is a #103 single hose shut off/ flow control valve from Misti Maid, Inc., Freemont, Calif., which is threaded. The valves 28 fit into ½ inch openings drilled through the cylinder pipe 44 and pipe thread tapped.

In the preferred embodiment, the piston 30 is comprised of a 1¼ inch coupling 60 with a 1¼×½ inch bushing 62 glued to each end. A piston disc 64 fabricated from ¼ inch acrylic sheet is secured to the bushing 62 at each end. The piston discs 64 are configured to slide in a sealed manner along the inner wall 26 of the cylinder 12.

Figure 2:
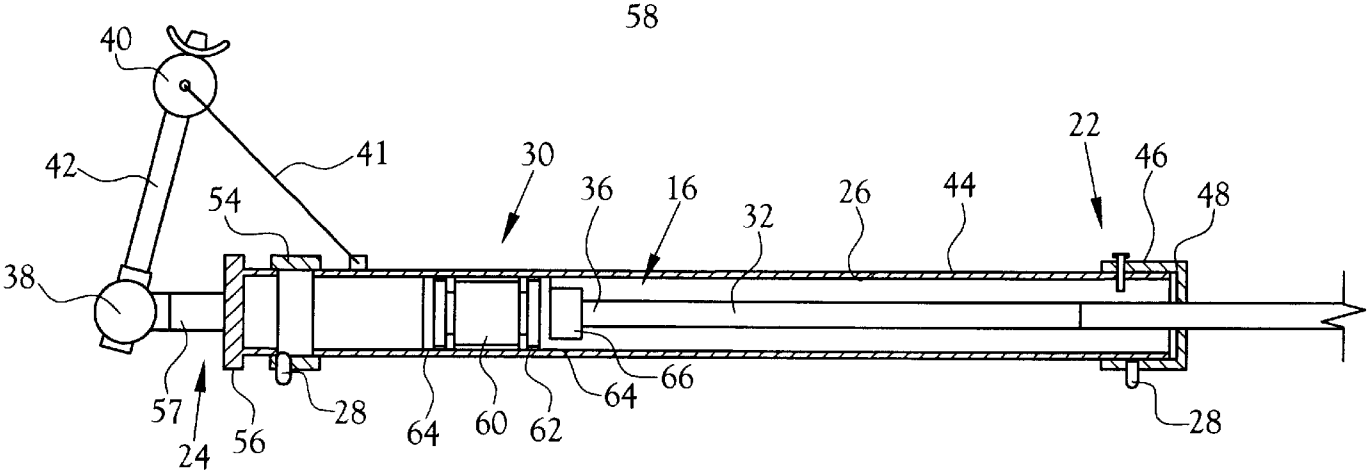
FIG. 2 illustrates a sectional view of the water exercise device taken at 2—2 of FIG. 1.

The rod 32 defines a first end 34 and a second end 36. The second end 36 of the rod 32 is secured to the piston 30 and is preferably received through the piston disc 64 and mounted in the bushing 62 behind the piston disc 64, as shown in FIG. 2. In the preferred embodiment, a reinforcement 66 is secured to the piston 30 and the second end 36 of the rod 32 and serves to reinforce the connection of the rod 32 and the piston 30. The reinforcement 66 also serves as a stopper to rest against the bushing 48 of the first end 22 of the cylinder 12. The first end 22 of the cylinder 12 is removable, as described above, such that the piston and rod assembly 16 is separable from the cylinder 12. The reinforcement 66 is preferably fabricated from a ½ inch coupling.

A ½ inch tee 68 is secured to the first end 34 of the rod 32. In the preferred embodiment, the handle 18 is comprised of two 6 inch long, ½ inch pieces of pipe 70 each secured to each end of the tee 68.

Figure 4:
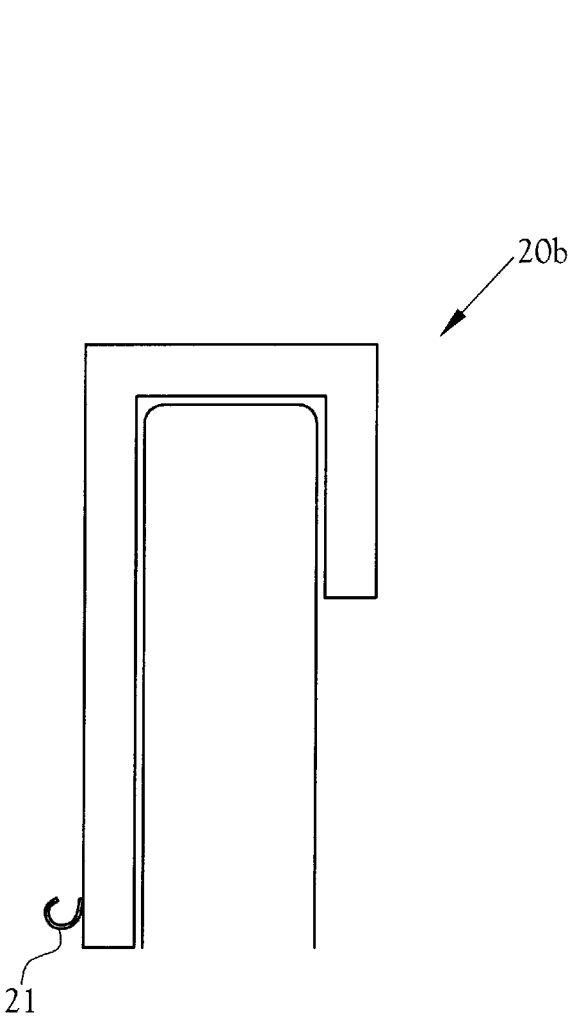
FIG. 4 illustrates an alternate embodiment of the attachment assembly for hooking over the lip of an above-ground pool.
Figure 3:
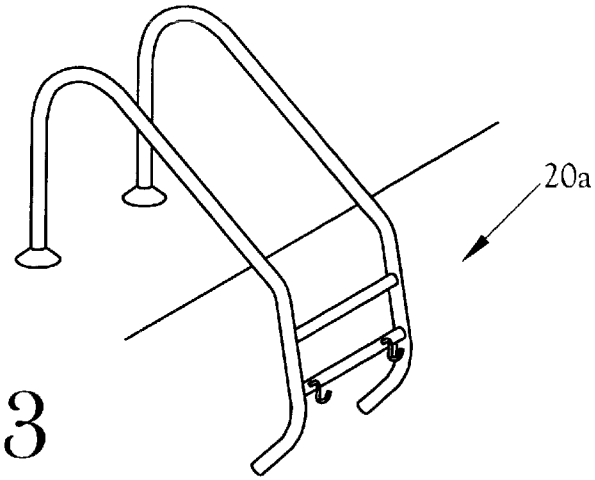
FIG. 3 is an alternate embodiment of the attachment assembly for attaching to a ladder.
Figure 5:
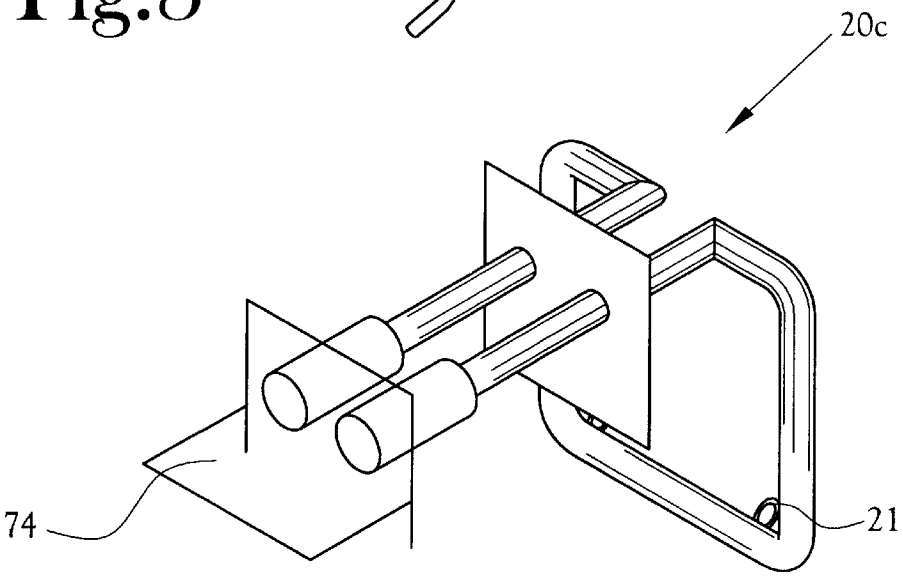
FIG. 5 illustrates an alternate embodiment of the attachment assembly for inserting in a skimmer; and, FIG. 6 illustrates the sequence for using the water exercise device; and, FIG. 7 is a perspective view of the water exercise device of the present invention including the flotation device.

The attachment assembly 20 is configured to securely support the water exercise device 10 in a pool, tub or similar body of water. Several embodiments of the attachment assembly 20 are depicted in the figures. Each embodiment of the attachment assembly 20 includes a set of hangers 21 which receive the lower foot bar 38 of the foot rest assembly 14. A first embodiment of the attachment assembly 20A is shown in FIG. 3, and is configured to secure to the ladder of a pool. Specifically, the attachment assembly 20A includes hangers 21 attached to the front end of the ladder steps for receiving the foot rest assembly. A second embodiment of the attachment assembly 20B is configured to hook over the edge of an above ground pool, as shown in FIG. 4. A third embodiment 20C, shown in FIG. 5, is configured to be inserted in the skimmer of an inground pool. Specifically, the attachment assembly 20C includes an extension 74 which is supported in the skimmer. Additionally, suction cups can be secured to the foot rest assembly 14 and can be utilized in pools with very smooth and rigid sides.

Figure 7:
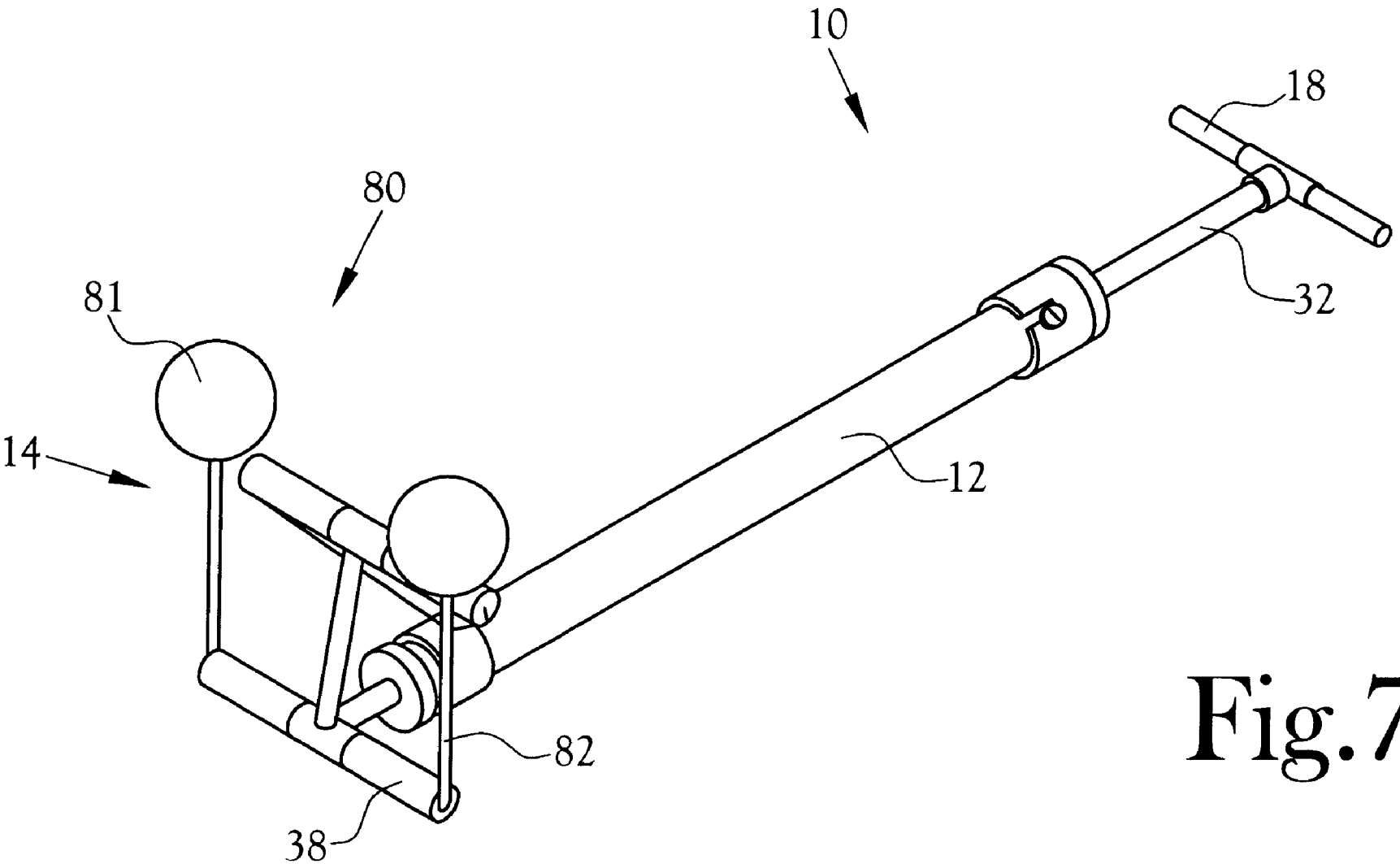

The flotation device 80 is configured to float on the surface of the water and maintain the water exercise device 10 at a substantially horizontal level below the water surface such that the device 10 can be used in a "free floating" manner. In the preferred embodiment, the flotation device includes two buoyant devices 81 one each secured to opposing ends of the lower foot bar 38, as shown in FIG. 7. The buoyant devices can be fabricated from watertight foam or plastic balls. The buoyant devices 81 are secured to the lower foot bar 38 via an attachment 82. The attachment 82 can be from a variety of materials such as nylon, plastic, or stainless steel. The total buoyancy required is at least six pounds, three pounds at each end of the lower foot bar 38.

It will be noted that the water exercise device 10 is fabricated from material which are suitable for use in water.

Figure 6:
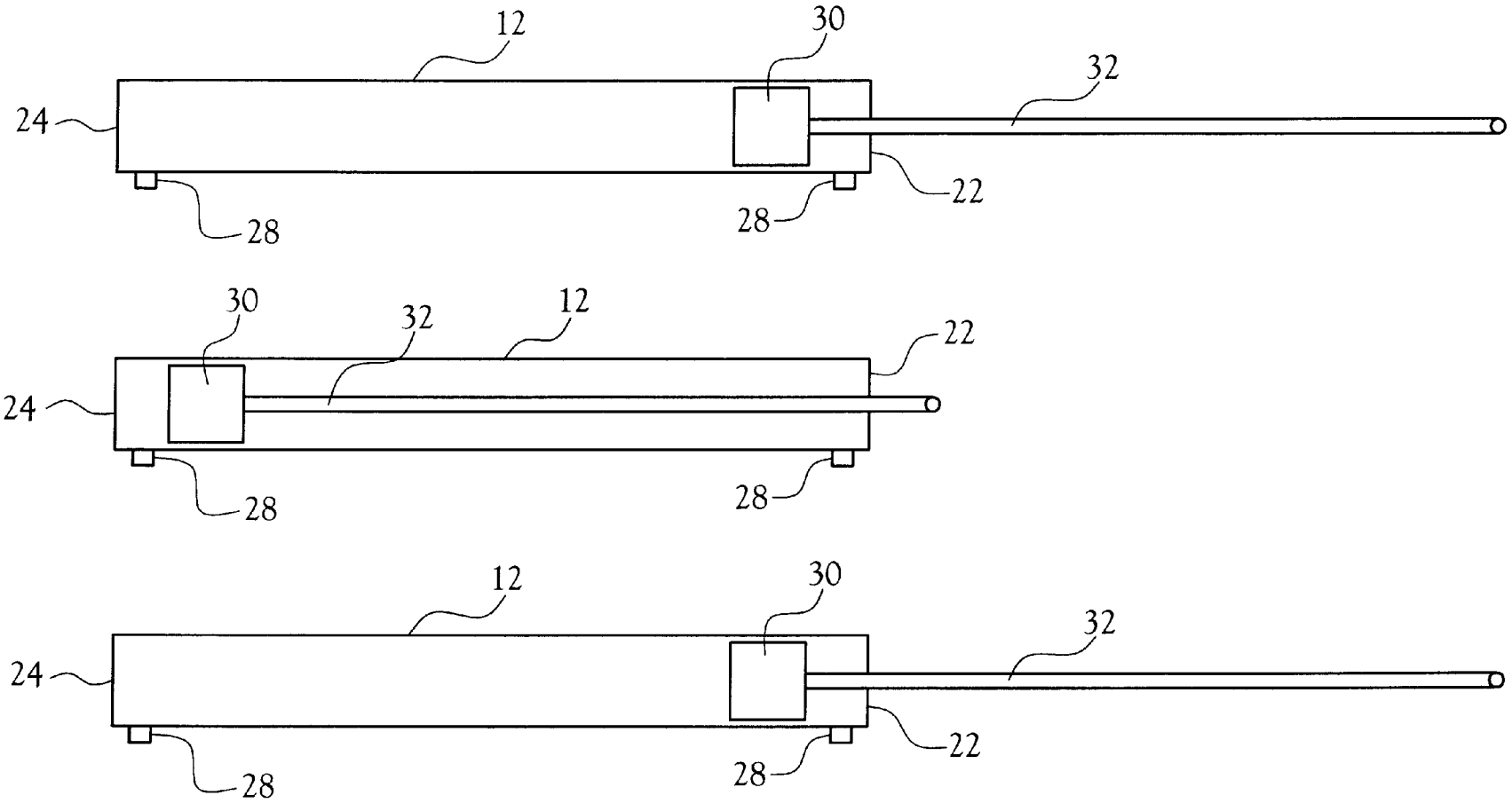

FIG. 6 illustrates the sequence for using the water exercise device 10. To use the water exercise device an appropriate attachment assembly 20 is mounted in the selected body of water and the lower foot bar 38 is secured to the hangers 21 of the attachment assembly 20. The user places his feet on the foot rest assembly 14, each on opposing sides of the cylinder 12. The user grips the handle 18 and pulls outward, stretching his body. Once the piston and rod assembly 16 are pulled fully through the cylinder 12, the piston and rod assembly 16 is forced back to the second end 24 of the cylinder 12. On pulling the piston 30 toward the first end 22 of cylinder 12, the cylinder 12 fills with water via the water flow valve 28 proximate the second end 24 of the cylinder 12. On pushing the piston 30 toward the second end 24, the piston 30 pushes water out the water flow valve 28 proximate the cylinder's second end 24 and pulls water in through the water flow valve 28 proximate the cylinder's first end 22. When the piston 30 is pulled toward the first end again, water exits the cylinder 12 through the first end 22 water flow valve 28 and enters the cylinder 12 through the second end 24 water flow valve 28. In the preferred embodiment, the water flow valves 28 can be adjusted to increase or decrease the rate of flow into and out of the cylinder 12 such that the resistance to pushing and pulling the piston 30 increases or decreases. In the preferred embodiment, the user wears a life jacket during the use of the water exercise device 10 for safety reasons and for keeping the body at the surface and in balance.

From the foregoing description, it will be recognized by those skilled in the art that a water exercise device offering advantages over the prior art has been provided. Specifically, the water exercise device is used in water and uses water for resistance exercises. Also, the water exercise device is simple in construction.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention,

I claim:

1. A water exercise device for use in water, said water exercise device comprising:

a cylinder defining a first end, a second ends a first water control valve mounted proximate said first end and a second water control valve mounted proximate said second end;

a piston and rod assembly defining a piston and a rod, said piston being slidable in a sealed manner between said first water control valve and said second water control valve of said cylinder, said rod defining a first end and a second end, said second end of said rod being secured to said piston, said first water control valve permitting water between said first end and said piston to flow out of said cylinder and permitting water to flow into said cylinder between said first end and said piston, said second water control valve permitting water between said second end and said piston to flow out of said cylinder and permitting water to flow into said cylinder between said piston and said second end;

a foot rest assembly being secured to said second end of cylinder; and, a handle secured to said first end of said rod.

2. The water exercise device of claim 1 further including an attachment assembly, said water exercise device being used in a pool, said attachment assembly being configured to releasably mount to a portion of the pool, said attachment assembly being configured to securely hold said foot rest assembly.

3. The water exercise device of claim 1 wherein said foot rest assembly includes a lower foot bar, an upper foot bar and a support shaft extending therebetween, said lower foot bar being secured to said second end of said cylinder, said support shaft being independent from said cylinder.

4. The water exercise device of claim 3 wherein the position of said upper foot bar is adjustable along said support shaft with respect to said lower foot bar.

5. The water exercise device of claim 1 further including a flotation device secured to said foot rest assembly, said flotation device for floating on the surface of the water and maintaining said water exercise device below the water surface.

6. A water exercise device for use in water, said water exercise device comprising:

a cylinder defining a first end, a second end and at least one water control valve mounted proximate said second end, said at least one water control valve permitting flow of water in and out of said cylinder;

a piston and rod assembly defining a piston and a rod, said piston being slidable in a sealed manner between said first end and said second end of said cylinder, said rod defining a first end and a second end, said second end of said rod being secured to said piston;

a foot rest assembly being secured to said second end of cylinder, said foot rest assembly including a lower foot bar, an upper foot bar and a support shaft extending therebetween, said lower foot bar being secured to said second end of said cylinder, the position of said upper foot bar being adjustable along said support shaft with respect to said lower foot bar; and, a handle secured to said first end of said rod.

* * * * *